United States Patent [19]

Farace

[11] Patent Number: 4,677,913

[45] Date of Patent: Jul. 7, 1987

[54] SAFE AND ARMING DEVICE

[75] Inventor: Louis P. Farace, Mesa, Ariz.

[73] Assignee: Motorola, Inc., Schaumburg, Ill.

[21] Appl. No.: 853,281

[22] Filed: Apr. 17, 1986

[51] Int. Cl.[4] ..... F42C 15/40

[52] U.S. Cl. ..... 102/215; 102/221

[58] Field of Search ..... 102/215, 221, 264

[56] References Cited

U.S. PATENT DOCUMENTS

| | | | |
|---|---|---|---|
| 2,642,801 | 6/1953 | Gleason | 102/264 |
| 3,750,583 | 8/1973 | White et al. | 102/215 |
| 3,853,062 | 12/1974 | Cole | 102/215 |
| 4,096,802 | 6/1978 | Waln | 102/215 |
| 4,099,466 | 7/1978 | Redmond et al. | 102/215 |
| 4,145,971 | 3/1979 | Graham et al. | 102/215 |
| 4,195,575 | 4/1980 | Deuker et al. | 102/232 |
| 4,470,351 | 9/1984 | Farace | 102/215 |

*Primary Examiner*—Charles T. Jordan

*Attorney, Agent, or Firm*—Eugene A. Parsons

[57] ABSTRACT

The present invention consists of a safe and arming device and method that utilizes a combination of linear and angular accelerometers to determine the type of weapon being used. From a determination of the type of weapon an arming distance is looked-up and divided by the linear velocity to provide an arming delay time. When the delay time has elapsed an actuator is activated thereby arming the munition.

11 Claims, 3 Drawing Figures

SAFE AND ARMING DEVICE

BACKGROUND OF THE INVENTION

The present invention relates, in general, to safe and arming devices and, more particularly, to safe and arming devices for munitions.

There are numerous safe and arming devices known in the art, such as U.S. Pat. No. 4,470,351 developed by the same inventor and assigned to Motorola Inc. Most existing safe and arming devices are either mechanical or electromechanical in nature. The mechanical versions utilize centrifugal gears which are retarded by runaway escapement damping devices which act as speed governors. These devices provide delay in terms of revolutions of the projectile after muzzle exit.

Electromechanical safe and arming devices operate on fixed time delays which provide long arming distances for high speed projectiles and short delays for slow speed projectiles.

While counting the turns of a weapon can provide constant calibers arming for a given weapon, regardless of launch velocity, a different caliber delay results when fired from a weapon having a different bore diameter or different twist.

SUMMARY OF THE INVENTION

Accordingly, it is an object of the present invention to provide a safe and arming device that overcomes the above deficiencies.

A further object of the present invention is to provide a safe and arming device that arms munitions at variable distances depending on the weapon.

Another object of the present invention is to provide a safe and arming device that provides a constant number of calibers arming for a spin stabilized electronic artillery fuze.

Still another object of the present invention is to provide a safe and arming device that can be used in numerous munitions without the need for individual adjustment.

The above and other objects and advantages of the present invention are provided by the safe and arming device described herein.

A particular embodiment of the present invention consists of a safe and arming device that utilizes a combination of tangential and axial accelerometers to determine the type of weapon being used and thereby provide a distance at which the projectile containing the safe and arming device is armed. These accelerometers are used in conjunction with processing logic circuits to arm the projectile after a preset distance has been achieved.

DETAILED DESCRIPTION OF THE DRAWINGS

Figure 1:
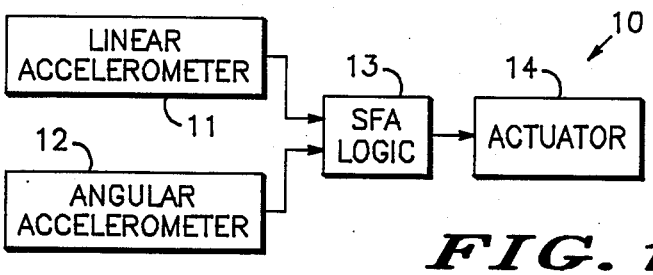
FIG. 1 is a block diagram of a safe and arming device embodying the present invention.

Referring now to the block diagram of FIG. 1, a safe and arming device, generally designated 10, embodying the present invention is illustrated. Safe and arming device 10 consists of a linear accelerometer 11, an angular accelerometer 12, a safe and arming logic means 13, and an actuator 14.

In operation, a projectile containing safe and arming device 10 is fired. Upon firing, a linear acceleration and an angular acceleration are measured by accelerometers 11 and 12 respectively. This information is then transmitted to logic means 13 which utilizes the acceleration information to determine the type of weapon used and set a time delay for activating actuator 14. This enables safe and arming device 10 to be activated at different distances depending upon the weapon used.

Figure 2:
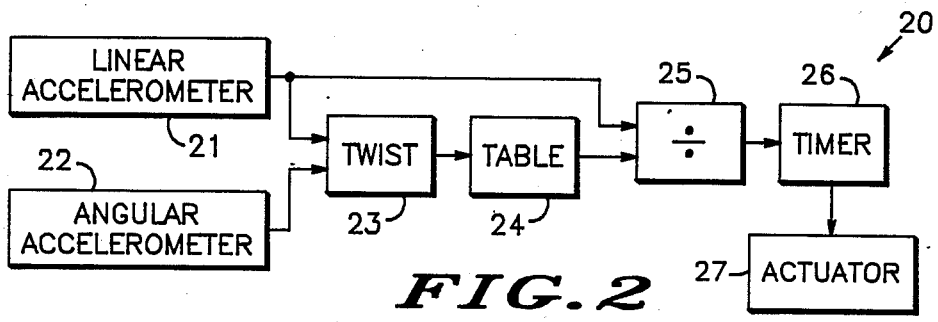
FIG. 2 is a more detailed block diagram of a safe and arming device embodying the present invention.

Referring now to the block diagram of FIG. 2, a safe and arming device, generally designated 20, embodying the present invention is illustrated. Safe and arming device 20 consists of a linear accelerometer 21, an angular accelerometer 22, a twist determining logic means 23, a lookup table 24, a dividing means 25, a timer 26 and an actuator 27.

In operation, a projectile containing safe and arming device 20 is fired. A linear acceleration is then determined by accelerometer 21 and is converted to a velocity, V, according to the equation:

$$V = \int_0^t a_V dt \tag{1}$$

where:

$a_V$ is the linear acceleration; and t is time.

Next, an angular acceleration is determined by accelerometer 22 and is converted into an angular velocity, W, according to the equation:

$$W = \int_0^t a_W dt \tag{2}$$

where $a_W$ is the angular acceleration.

The linear, V, and angular, W, velocities are then transmitted to twist determining means 23. Twist determining means 23 determines the ratio of linear velocity to angular velocity, V/W. The twist ratio, V/W, is unique for each different type of weapon. Once the twist ratio is calculated this is used as a reference number designating the type of weapon. The twist ratio, V/W, is then transmitted to lookup table 24, such as a read only memory, where a prestored number, X, representing the arming distance is found. This number is then transmitted to divider 25 where it is divided by the linear velocity, X/V, to determine the time delay before arming.

Figure 3:
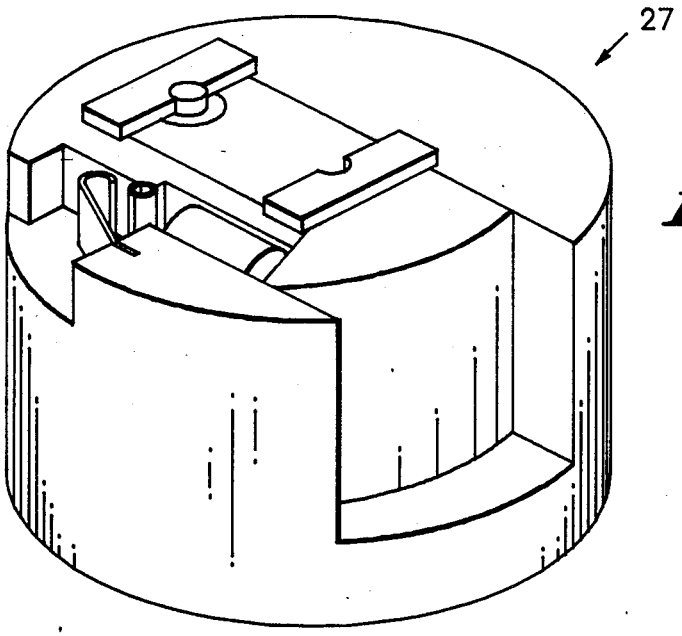
FIG. 3 illustrates a piston type actuator.

The time delay is then loaded into timer 26. Once the amount of time delay has passed, timer 26 sends a signal to actuator 27 that causes the projectile to be armed. An example of actuator 27 is the piston type actuator described in U.S. Pat. No. 4,145,971 entitled "Electronic Time Delay Safety and Arming Mechanism" and assigned to Motorola Inc. FIG. 3 is an illustration of a piston type actuator, the operation of which is described in the above-referenced patent.

The following table will assist in a more specific understanding of the operation of safe and arming device 20. Table 1 consists of several columns indicating weapon size; average twist ratio, V/W; and the arming distance stored in the lookup table.

TABLE 1

| Weapon | Ratio | Distance |
|---|---|---|
| 105 mm | 1:18 | 137 |
| 4.2" Mortar | 1:20 | 140 |
| 8" | 1:25 | 266 |

Table 1 shows that a 4.2" mortar generally has a twist ratio of 1:20 and assigns a distance of 140 to this ratio. When a 4.2" mortar is fired, lookup table 24 will provide a 140 arming distance that will be divided by the velocity to provide the time delay. This serves to compensate for minor variations in velocities and cause most 4.2" mortars to arm after 140 ft.

A specific method of operation of safe and arming device 20 can be represented by the following scenario. A lookup table is stored in table 24 that will provide the following constants for the given range of twist ratios:

TABLE 2

| Ratio Range | Distance |
|---|---|
| >1:15 | — |
| 1:15 to 1:19 | 137 |
| 1:19 to 1:22 | 140 |
| 1:22 to 1:25 | 200 |
| 1:25 to 1:27 | 266 |
| <1:27 | — |

Upon firing of the projectile, the linear velocity is determined to be 50 ft/sec and the angular velocity is determined to be 998 ft/sec. The velocities are then transmitted to twist determining means 23 where the twist ratio is calculated to be 50/998 or 1:19.96. From Table 1, this ratio would indicate that the weapon is a 4.2" mortar. This ratio is then transmitted to table 24 where a distance of 140 is given. This distance, 140, is then transmitted to dividing means 25 which produces the number 140/50 (or 2.8). This number, 2.8, is then loaded into timer 26. Once 2.8 seconds has passed the timer transmits a signal to actuator 27 that will cause the projectile to be armed.

As shown in Table 2, a ratio larger than 1:15 or smaller than 1:27 will not arm the projectile. These ratios represent numbers that would only result from a defective device or firing. If more accuracy is desired than that shown above, the look-up table, shown in Table 2, can be expanded to any accuracy.

Thus, it is apparent to one skilled in the art that there has been provided in accordance with the invention, a device and method that fully satisfies the objects, aims and advantages set forth above.

It has been shown that the present invention provides a safe and arming device that arms a munition at variable distances depending upon the weapon used; and that does not require individual adjustment.

While the invention has been described in conjunction with specific embodiments thereof, it is evident that many alterations, modifications, and variations will be apparent to those skilled in the art in light of the foregoing description. Accordingly, it is intended to embrace all such alterations, modifications and variations in the appended claims.

I claim:

1. A safe and arming device comprising:

linear accelerometer means for determining linear acceleration, said linear accelerometer having an output;

angular accelerometer means for determining angular acceleration, said angular accelerometer having an output;

actuator means for actuating a munition, said actuator means having an input; and safe and arming logic means for determining a time delay and actuating said actuator means, said safe and arming logic means having a first input coupled to said output of said linear accelerometer, a second input coupled to said output of said angular accelerometer, and an output coupled to said input of said actuator.

2. The safe and arming device of claim 1 wherein said safe and arming logic means comprises:

twist determining means for determining a ratio of linear acceleration to angular acceleration, said twist determining means having a first input coupled to said output of said linear accelerometer, a second input coupled to said output of said angular accelerometer, and an output;

lookup means for looking up a variable in response to an input from said twist determining means, said lookup means having an input coupled to said output of said twist determining means and an output;

first dividing means for dividing a first input signal by a second input signal, said first dividing means having a first input coupled to said output of said lookup means, a second input coupled to said output of said linear accelerometer, and an output;

timing means for activating said actuator following a time delay, said timing means having a input coupled to said output of said first dividing means and an output coupled to said input of said actuator.

3. The safe and arming device of claim 2 wherein said lookup means comprises a memory device having an input coupled to said output of said twist determining means and an output coupled to said first input of said first dividing means.

4. The safe and arming device of claim 2 wherein said twist determining means comprises a second dividing means for dividing a first input signal by a second input signal, said second dividing means having a first input coupled to said output of said linear accelerometer, a second input coupled to said output of said angular accelerometer, and an output coupled to said input of said lookup means.

5. The safe and arming device of claim 1 wherein said actuator means comprises a piston actuator having an input coupled to said output of said safe and arming logic means.

6. A safe and arming device comprising:

linear accelerometer means for determining linear acceleration, said linear accelerometer having an output;

angular accelerometer means for determining angular acceleration, said angular accelerometer having an output;

twist determining means for determining a ratio of linear acceleration to angular acceleration, said twist determining means having a first input coupled to said output of said linear accelerometer, a second input coupled to said output of said angular accelerometer, and an output;

lookup means for looking up a variable in response to an input from said twist determining means, said lookup means having an input coupled to said output of said twist determining means and an output;

first dividing means for dividing a first input signal by a second input signal, said first dividing means having a first input coupled to said output of said lookup means, a second input coupled to said output of said linear accelerometer, and an output;

timing means for activating said actuator following a time delay, said timing means having a input coupled to said output of said first dividing means and an output coupled to said input of said actuator; and actuator means for actuating a munition, said actuator means having an input coupled to said output of said timing means.

7. The safe and arming device of claim 6 wherein said lookup means comprises a memory device having an input coupled to said output of said twist determining means and an output coupled to said first input of said first dividing means.

8. The safe and arming device of claim 6 wherein said twist determining means comprises a second dividing means for dividing a first input signal by a second input signal, said second dividing means having a first input coupled to said output of said linear accelerometer, a second input coupled to said output of said angular accelerometer, and an output coupled to said input of said lookup means.

9. The safe and arming device of claim 6 wherein said actuator means comprises a piston actuator having an input coupled to said output of said safe and arming logic means.

10. A method of arming a munition comprising the steps of:

firing said munition from a weapon;

measuring a linear and an angular acceleration of said munition;

processing said linear and angular accelerations to derive linear and angular velocities of said munition;

dividing said linear velocity by said angular velocity providing a twist ratio;

looking-up a distance in a lookup table that corresponds to said twist ratio;

dividing said distance by said linear velocity deriving a time delay;

loading said time delay into a timer; and activating an actuator after said time delay has elapsed.

11. A method of arming a munition comprising the steps of;

firing said munition from a weapon;

measuring a linear and an angular velocity of said munition;

determining a type of munition from a ratio of the linear and angular velocities;

determining the arming distance of the munition using said type of munition;

determining a time delay by dividing the arming distance by the linear velocity of the munition;

activating an actuator after said time delay has elapsed.

* * * * *